US007823640B2

(12) United States Patent
Flanders

(10) Patent No.: US 7,823,640 B2
(45) Date of Patent: Nov. 2, 2010

(54) WELLHEAD FLOWLINE PROTECTION AND TESTING SYSTEM WITH ESP SPEED CONTROLLER AND EMERGENCY ISOLATION VALVE

(75) Inventor: Patrick S. Flanders, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 472 days.

(21) Appl. No.: 11/977,204

(22) Filed: Oct. 23, 2007

(65) Prior Publication Data

US 2009/0101338 A1 Apr. 23, 2009

(51) Int. Cl.
*E21B 34/02* (2006.01)
*E21B 33/02* (2006.01)

(52) U.S. Cl. ..... 166/250.01; 700/282

(58) Field of Classification Search ..... 166/250.01, 166/376; 137/14, 148, 487.5; 700/282
See application file for complete search history.

(56) References Cited

U.S. PATENT DOCUMENTS 4,021,700 A * 5/1977 Ellis-Anwyl ..... 361/28
5,335,730 A 8/1994 Cotham, III
5,983,164 A 11/1999 Ocondi
2005/0166961 A1 8/2005 Means et al.
2006/0008355 A1 * 1/2006 Low ..... 417/36

FOREIGN PATENT DOCUMENTS

WO WO 97/09662 A1 3/1997
WO WO 00/29715 A1 5/2000
WO PCT/US2008/001698 12/2008

* cited by examiner

*Primary Examiner*—Daniel P Stephenson
(74) *Attorney, Agent, or Firm*—Abelman, Frayne & Schwab

(57) ABSTRACT

An ESP variable speed drive controller functions in conjunction with a safety logic solver, dedicated pressure sensors and a surface emergency isolation valve, or safety shut-off valve (SSV), to perform a full functional test of the complete wellhead flowline system. The method includes the step of using a plurality of pressure transmitters to monitor the flowline pressure during normal operations and during a full stroke test of the safety shutoff valve and adjusting the speed of the downhole ESP during the test to maintain the pipeline pressure within predetermined safe pressure limits. This wellhead flowline protection system and method utilizes the downhole ESP speed controller and an SSV to ensure that dangerous pressure levels are not reached and provides for full functional safety testing of the wellhead system. The ESP motor speed controller is used to permit functional testing and remove the pressure source from protected downstream flowline piping.

19 Claims, 1 Drawing Sheet

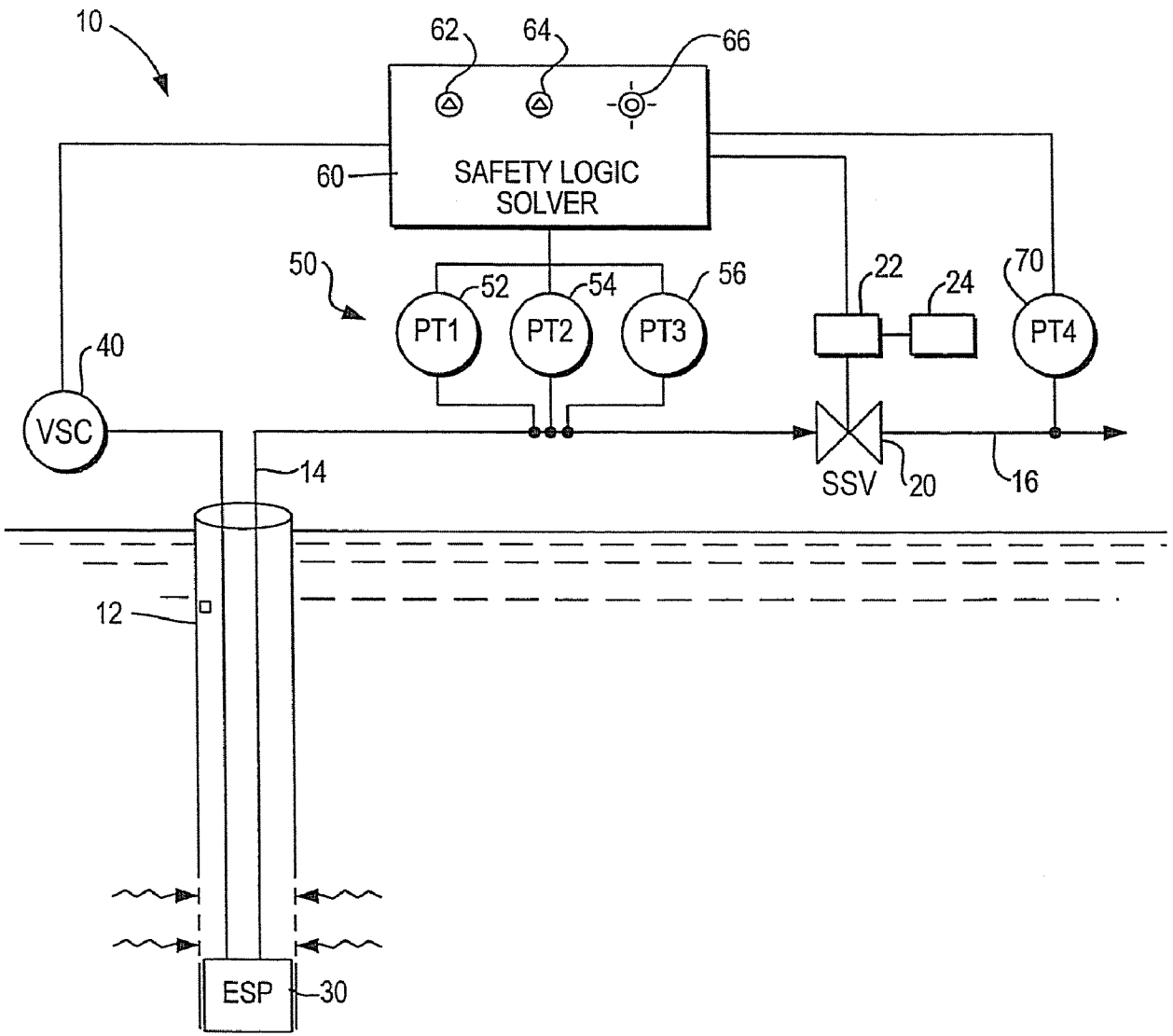
10
SAFETY LOGIC SOLVER
60
62
64
66
PT1
PT2
PT3
PT4
52
54
56
70
50
22
24
20
SSV
16
14
12
VSC
40
ESP
30

WELLHEAD FLOWLINE PROTECTION AND TESTING SYSTEM WITH ESP SPEED CONTROLLER AND EMERGENCY ISOLATION VALVE

FIELD OF THE INVENTION

This invention relates to a protection system for a wellhead piping flowline that is pressurized by a downhole electric submersible pump (ESP) to protect downstream low pressure rated transportation and distribution pipelines, and that also provides a fully-automated safety and fault test function.

BACKGROUND OF THE INVENTION

A wellhead high integrity protection system (HIPS) protects flowlines connected to a wellhead from overpressure should a downstream block valve close. The pressure source can be the oil-bearing geologic formation pressure. This pressure is known as the wellhead shut in pressure and it is based on geologic parameters, it is continuous, it cannot be controlled. i.e. it cannot be "turned off" in the conventional sense of that term. Multiple automated block valves are required in series downstream of the wellhead pressure source so that in case one valve leaks or fails to close, another will function to do so.

Although the surface safety valves (SSV) generally used in these applications are extremely reliable, the worst case scenario is considered in the design of safety systems. This is known in the field of safety instrumentation as a design that provides hardware dangerous fault tolerance. In the SSV tight shutoff testing method, valves will not only close, but will actually provide positive shutoff against the constant wellhead pressure, i.e., there will be no detectable leakage. Two series valves are required to allow for a tight shutoff test and the system includes a vent valve between the two series shutdown valves and an intermediate array of pressure transmitting sensors. In the preferred arrangement of the apparatus and system all of the function components are in communication with, and directed by a safety logic solver (SLS). Command and data signals can be carried over wires or communicated wirelessly.

Electric submersible pump systems and related technologies have been adopted to improve oil/gas recovery when production from the reservoir has been diminished by prevailing reservoir conditions. Downhole electric submersible pumps (ESP) are utilized to lift oil and gas to the surface where they are received by a wellhead flowline system for transportation and distribution. The pipeline pressure, flow rate and numerous other variables are monitored at the wellhead in order to insure, among other things, the safe operation of the pipeline and distribution system downstream of the wellhead. In the immediate vicinity of the wellhead, conventional mechanical protection systems can include the use of thick-walled pipe having an appropriately high pressure rating to withstand the high pressures that can be generated by the ESP. In the interests of economy, the pipeline downstream of the wellhead is fabricated from pipes having a defined lower safe operating pressure range. Relatively thinner walled pipe is used in the flowline system.

One problem that the new downhole ESP production controller introduced was that although it provided the required pressure boost to keep the oil flowing, should an intermediate block valve close in the long network of flowlines and trunklines between an offshore production platform and the onshore GOSP, the pressure would build in the piping network to the pump's fully-blocked discharge pressure which is much higher than the normal flowing pipeline pressure. A flowline network suited for normal operations does not have a sufficiently high pressure rating to withstand the fully-blocked pressure of the ESP.

Running downhole pumps against a blocked discharge is not a normal practice, but is considered the worst case scenario when designing associated safety systems. The downhole ESP's are electrically driven and control of the pump as a potential source of dangerous pressure is electrical.

In order to insure the maximum in safe operations, so-called high integrity protection systems, or HIPS, have been developed for various applications. The conventional safety design practice of the prior art has been to specify flowlines that transport produced oil/gas from wellheads with sufficient wall thickness to contain the fully-blocked discharge pressure under theoretically possible worst case conditions. However, this approach proved to be impractical with the introduction of electric submersible pumps that can produce a very high wellhead shut-in pressure greater than 3000 psi. One approach that has been adopted is to continuously monitor the downstream flowline pressure and cut the power supply to the ESP before the flowline pressure reaches a dangerous level.

It is also known in the prior art to provide sub-surface safety valves (SSSV) for the purpose of shutting in the well and testing of these types of valves has been disclosed for the purpose of ensuring that the wellhead shutdown system will function properly, as for example in U.S. Pat. No. 4,771,633.

Other systems have been disclosed to allow the electric submersible pump to continue to operate in a re-circulation mode in the event of an emergency that requires the well to be shut in. Such systems are disclosed in U.S. Pat. No. Re 32,343 and U.S. Pat. No. 4,354,554.

Systems are also known for use in conducting an emergency shut down test of safety shut-off valves. For example, U.S. Pat. No. 7,079,021 discloses an emergency shut-down device controller and sensors to provide data to the controller, the controller having a processor, a memory coupled to the processor and an auxiliary input, wherein an emergency shutdown test is stored in the memory, and the auxiliary input is adapted to receive a binary signal and sensor data. Routines are stored in the memory and are adapted to be executed on the processor to allow the emergency shutdown test to be performed in response to the receipt of a binary signal at the auxiliary input and to cause sensor data to be recorded in the memory during the emergency shutdown test.

It would be desirable to provide oil/gas operations that utilize electric submersible pumps with a wellhead flowline protection system that is capable of providing fully automated proof-testing and self-diagnostics without the need for shutting in the well for the purpose of conducting the test.

It is therefore an object of the present invention to provide a wellhead control system and a method for the continuous monitoring and automatic testing for potential faults in a flowline pressurized by an electric submersible pump while continuing the operation of the ESP.

A further object of the present invention is to provide a reliable, automated testing and shutdown system to replace the instrumented flowline protection systems of the prior art which require significant manpower and that are based upon complicated manual proof-testing requirements.

Another object of the invention is to provide a safety test procedure for a well having an ESP that can be performed without interrupting production by turning off the ESP.

Yet another object of the present invention is to eliminate the dependence on manual human intervention for proof-testing of the system by providing an automatic functional testing and diagnostic method and system.

SUMMARY OF THE INVENTION

The above objects and other advantages are achieved with the method and system of the present invention in which an ESP variable speed drive controller functions in conjunction with a safety logic solver and a surface emergency isolation valve, or safety shut-off valve (SSV), to perform a full functional test of the complete wellhead flowline system.

In the preferred embodiment, the ESP speed controller is an electronic device. The method includes the step of using a plurality of pressure transmitters to monitor the flowline pressure during normal operations and during a full stroke test of the safety shutoff valve and adjusting the speed of the downhole ESP during the test to maintain the pipeline pressure within predetermined safe pressure limits. This wellhead flowline protection system and method utilizes the downhole ESP speed controller and an SSV to ensure that dangerous pressure levels are not reached and provides for full functional safety testing of the wellhead system. The ESP motor speed controller is used to permit functional testing and remove the pressure source from protected downstream flowline piping.

The system and method of the present invention constitutes a completely self-testing high integrity protection system to protect ESP wellhead flowlines by utilizing redundant sensors, a safety logic solver and diverse final elements. Final elements include the SSV and the ESP speed controller. They use completely different technology to protect the lower rated flowline piping from overpressure.

In one preferred aspect of the invention, valve position feedback data is also collected and processed by the safety logic solver. Valve (SSV) position data transmitted to the safety logic solver provides a way to verify the ability of the SSV to respond to a demand signal. Valve performance testing is required by industry safety standards, but the methods to perform the required testing and verification are not specified. In the preferred embodiment, each SSV includes a fail-safe actuator with a positive spring return. The valves can be of the electrically or hydraulically actuated type.

In the context of the present invention, the final elements include the ESP variable speed drive controller, and a surface emergency isolation valve, or shut-off safety valve (SSV). The principal steps include: (1) closing the SSV; (2) ramping down the ESP using the variable speed controller (VSC); (3) opening the SSV; and (4) ramping up the ESP to normal operating speed. During the testing of the final elements, the process sensors transmit data to the safety logic solver on the pressure in the flowline.

In the system of the present invention, the performance characteristics of the pump, e.g., efficiency, flow rate and the like, are not measured. Rather, it is the overall pump response to the programmed signals transmitted from the safety logic solver that are determinative of the condition of the safety system. The flowline pressure is sensed with safety-critical pressure transmitters and their respective signals are transmitted to the safety logic solver for a determination of whether the pump is responding within acceptable limits to the command signals from the safety logic solver.

The present invention uses a single surface safety shut-off valve closed with the pump running and monitors the pressure upstream of the closed valve for an increase to verify proper valve seating and valve stem position. With the valve still closed, the pump speed is decreased until a pressure decrease indicates that the pump variable speed controller is responding to the safety logic solver controller commands. Finally, the surface safety shut-off valve is opened and the pump is ramped back up to normal speed. All parts that make up the safety instrumented system (SIS) including the pressure sensors on the input side, the safety logic solver, and the diverse outputs, i.e. the single surface safety shut-off valve and the ESP variable speed controller are all tested.

In a preferred embodiment, three pressure sensing transmitters monitor the flowline for high and low pressure and are voted in a two-out-of-three protocol by the safety logic solver. Using this system, a failure of one of the pressure sensors or a failure to detect an internal fault will result in the signal from that sensor being discounted, and the process will remain on line and the remaining two sensors will continue to protect the system. The safety logic solver is also programmed to recognize the defect or failure of the single sensor and alert maintenance personnel, e.g. via an audible and/or visible alarm, text message to operating personnel, or other known safety procedures. During any such time as when a sensor is in a known failure mode, the system converts to a voted one-out-of-two protocol.

Pressure sensors and safety logic solvers are commercially available as TUV certified devices from multiple suppliers. The ESP speed controllers and SSV's are not currently available as third-party safety certified devices. Therefore, functional testing is of critical importance to the operational safety of the system. The preferred SSV uses an electric fail-safe function that provides control and safety. Communications are hardwired to the ESP controller, the SSV and to the process sensors.

In a particularly preferred embodiment, the safety protocol known as FF-SIS is employed. The FF-SIS standards provide for individual device self-diagnostics and communications of data from the monitoring process. While the adoption and application of this new safety standard to the present invention is within the ordinary skill of one in the art, the details of its deployment is beyond the scope of the present invention.

Automated functional testing of the system is initiated utilizing the programmed safety logic solver. The testing can be initiated locally at the wellhead or remotely from a central control room. The logic solver will run through a pre-programmed set of diagnostic tests of the final elements, while monitoring the flowline pressure sensors. The system and method of the invention provides for an end-to-end functional safety check of the complete system, including the final elements, a logic solver and a plurality of sensors. The method is described in more detail below.

Step 1—Closing the SSV

The automated functional test routine is initiated at the wellhead site, e.g., manually with a push button or other switch, or electronically from a remote location. The safety logic solver (SLS) initiates a full stroke of the SSV from the open to the closed position. While the valve is traveling from the open to the closed position, valve response data (position vs. time) is collected and stored by the safety logic solver. This data is known as the valve signature and can be used to diagnose changes in the valve performance that can indicate degraded performance and a potential for failure. If the valve fails to move or excess delay is indicated, an alarm is initiated by the safety logic solver and annunciated locally to indicate that the system failed the functional test. When the valve reaches the closed position as verified, e.g., by an integral actuator limit switch, the pressure sensors will indicate an increase in pressure because the ESP is now running against the closed valve. Once the "valve closed" limit is reached, a predetermined test period is initiated by the SLS during which the pressure increase is monitored. When the predetermined pressure value or increase is detected, the safety logic solver will send a command to the ESP speed controller to reduce the speed of the pump. If a pressure increase is not detected, the test is aborted and a "test failed" alarm is initiated. In this test protocol, a SSV "tight shutoff" is not verified. However, the ability to fully close and develop an increase in pressure in the upstream piping is a sufficient functional test for the safety application of the present invention.

Step 2—Ramping Down the ESP

Once the SSV is fully closed and the flowline pressure increase is successfully detected, the safety logic solver sends a command signal to the ESP variable speed controller to ramp down the speed of the pump. Starting with the output from the safety logic solver to the ESP speed controller, a predetermined time period is provided to detect a decrease in pressure in the flowline. If a decrease in pressure is not detected during the time allotted, the safety logic solver will open the SSV and initiate a "test failed" alarm. If a pressure decrease is detected, the ESP variable speed controller is deemed to have passed the functional test. Thus, the test method includes the ability to decrease the pump speed, detect the pressure drop upstream of the closed SSV, and return the pump speed to normal.

Step 3—Opening the SSV

Following the detection of the pressure drop described in step 2 above, the safety logic solver will transmit a signal to reopen the SSV. A predetermined time period is provided for the valve to initiate movement from the closed limit switch position. Should the valve fail to move before the time period elapses, the logic solver will completely shut down the ESP. Should the valve fail to completely return to the fully open position, a fault alarm will be initiated, but the ESP will be returned to the predetermined normal operating speed and the flowline pressure will continue to be monitored by the SLS.

Step 4—Ramping Up the ESP to Normal Operating Speed

When the safety logic solver receives a signal from the actuator limit switch indicating that the SSV has moved from the closed position, a signal is transmitted to the ESP speed controller to return to the normal operating speed.

In the event that a safety demand signal is generated during the SSV full-stroke test or the pump speed ramp test, the emergency shutdown trip signal will override the test sequence protocol and bring the pump to a full stop and stroke the SSV to the fully closed position.

It will be understood from the above description that the system verifies the functioning of the sensors to detect flowline pressure changes, the logic solver to monitor those signals, the ESP variable speed drive controller to reduce the speed of the pump, and the SSV to isolate the flow of oil/gas from the downstream flowline network. In the system of the invention, the preferred SSV actuator is an electric fail-safe device with a spring return. The functioning of the safety logic solver is verified by the proper operation of the final elements and through monitoring of pressure changes via the dedicated sensors.

Should a fault be detected with the valve, pump speed controller, or sensors, personnel are alerted and can take appropriate steps to perform the required maintenance without an adverse impact on safety or operations. Most importantly, the invention provides a safety instrument system (SIS) for a HIPS that can be completely tested without interrupting the oil/gas production through the flowline during the test protocol and that can respond immediately to shut down the ESP and SSV, should that become necessary.

The system of the invention is preferably factory built and tested, and can be skid-mounted with flange connections on the input and output of the flow piping system for ease of modular installation in the field. The consistent use of the same design also has the advantage of reducing the burden on operations and maintenance personnel in the performance of routine system safety testing over the installed life of the modular units.

The present invention thus provides a wellhead high integrity protection system that protects flowlines connected to a wellhead from overpressure should a downstream block valve close. In the system of the present invention, the pressure source is the downhole electrical submersible pump, or ESP, which is used when the topside (surface) pressure of a well decreases to a point where the well will no longer "free flow" or the topside pressures are not adequate to transport the oil/gas to a gas oil separation plant (GOSP) located farther away from the producing wellhead location.

BRIEF DESCRIPTION OF THE DRAWINGS

The invention will be further described below in conjunction with the attached drawing which is a schematic illustration of a wellhead flowline piping arrangement pressurized by an electric submersible pump that is modified in accordance with the method and system of the invention.

DETAILED DESCRIPTION OF A PREFERRED EMBODIMENT

The invention will be further described with reference to the attached drawing which depicts a wellbore casing 12 from which extends a production tubing 14 that is constructed from a high pressure rated piping that terminates at surface safety shut-off valve 20. Downstream of the SSV 20, conventional piping 16 rated for a lower pressure is installed for the transportation and distribution of the product.

The downhole end of production tubing 14 is attached to electric submersible pump 30 which delivers the pressurized stream of reservoir gas and/or oil for eventual transportation and distribution through the downstream flowline piping network. In accordance with the invention, a variable speed drive controller 40 is operatively connected to downhole pump 30 and also to safety logic solver 60.

A plurality of pressure transmitting sensors 50 are installed on the high pressure rated flowline piping 14 and are in data communication with safety logic solver 60. In the embodiment illustrated, three pressure sensors 52, 54, 56, (also identified as PT1, PT2 and PT3), are installed; in addition, a fourth pressure sensor 70 (PT4) is installed downstream of safety shut off valve on the low pressure rated flowline 16 and in data communication with the safety logic solver.

A valve actuator 22 is installed on valve 20 and is in controlled communication with safety logic solver 60. In this embodiment, the valve actuator is also equipped with limit switch 24 to indicate the SSV fully-opened and fully-closed positions, which are communicated to the SLS.

The pre-programmed safety logic solver 60 includes a local trip switch 62, which is conveniently a push button, for initiating a safety shutdown when an emergency condition exists. Pressing the push button 62 will result in actuator 22 closing SSV 20 and terminating power to the ESP to promptly reduce the pressure in flowline 14.

A local functional test push button switch 64 is provided for initiating the functional and safety testing of the system in the system in the field. Also illustrated is a local fault indicator 66 which preferably includes a light and can include an audible alarm. The alarm can also be transmitted via wired circuits or wirelessly to a remote control room to determine whether any additional action is required to continue the safe operation of downstream units.

During normal operations, the pressure transmitters 52, 54 and 56 monitor flowline pressure for any unusual variations that may require a safety response, the pressure transmitter 70 which is downstream of the SSV is a non-safety related transmitter that is used to monitor flowline pressure.

It will be understood that the safety logic solver includes a pre-programmed test protocol without the need for personnel involvement in the step-by-step effectuation of the test. The programmed safety test includes timed intervals of predetermined length and the immediate initiation of one of predetermined alternative actions in the event that specified conditions are not met within the clocked interval. As will be understood by one of ordinary skill in the art, the conduct of such tests by personnel using visual observation methods, stopwatches, and the like cannot compare with the timeliness and accuracy of a programmed protocol.

As noted above, the functional tests can be initiated remotely from a control room; automatically by the predetermined periodic initiation of the test, e.g. monthly at a specified time and date in accordance with the program installed on the safety logic solver; or by field personnel using the push button 64. Upon initiation of the function test, actuator 22 receives a signal to initiate closing of the valve 20. A signal is transmitted by indicator 24 upon movement of the valve from the fully opened position. Signals from the pressure transmitters 52, 54, 56 are monitored for detection of a pressure increase; assuming the pressure increase is detected, the speed of the ESP 30 is ramped down by speed controller 40. Upon the closing of valve 20 and the reduction in the speed of the ESP, the safety logic solver 60 confirms a decrease in the pressure in line 14 based upon data received from the pressure transmitters 52, 54 and 56. Thereafter, a signal is transmitted to valve actuator 22 to open valve 20 and the speed of the ESP is ramped up by variable speed controller 40 to provide the desired normal operating flowline pressure as verified by pressure transmitter 70.

It will be understood that the fault indicator 60 will provide an alarm and register a time-stamped fault in the memory of the safety logic solver in the event that the limit switch 24 fails to register a fully-opened or a fully-closed condition in the safety shut-off valve 20. Faults will also be registered and alarmed in the event that no pressure increase is detected by 52, 54 and 56 as the SSV is moved to the closed position or if no pressure decrease is detected, after the slowing of the pump speed has been signaled to the variable speed drive 40. Other diagnostics include delays in valve travel from either the open or closed positions that exceed the predefined time limit.

As previously noted, should an emergency shutdown signal be received by the safety logic solver, e.g., as a result of tripping of the push button 62 by personnel at the site, or the transmission via wire or wirelessly, of an emergency shut down signal, the conduct of the safety and fault test is immediately overridden and the safety logic solver sends a signal to shut down the ESP and to close the emergency isolation valve 20. In a preferred embodiment, the variable speed drive 40 is included in the emergency shut down program so that the speed of the ESP is slowed before the electrical power is interrupted. This reduces the potential for any adverse impact on the pump that might occur by simply switching off the power.

While the system and its method of operation have been described in detail above, various modifications and alternatives will be apparent to those of ordinary skill in the art from this description and the scope of the invention is to be determined with reference to the claims that follow.

I claim:

1. An automated system for the safety testing of a wellhead piping flowline employed for the distribution of a fluid stream of gas and/or oil pressurized by a downhole electric submersible pump (ESP), the system comprising:

a. a surface safety shut-off valve (SSV) positioned in the flowline and in fluid communication with the ESP;

b. a pre-programmed safety logic solver (SLS) for conducting a safety test protocol and recording the results electronically, and for issuing emergency shut-down signals;

c. a plurality of pressure sensors for measuring the internal flowline pressure upstream of the SSV;

d. a valve actuator for closing the SSV in response to either a test-initiating signal or an emergency shut-down signal transmitted by the SLS and for opening the SSV in response to a signal transmitted by the SLS;

e. a variable speed drive controller operatively connected to the ESP for varying the speed of the ESP, and thereby the pressure of the fluid in the flowline, in response to a signal from the SLS and f. an emergency ESP shut-off switch for interrupting power to the ESP in response to an emergency shut-down signal from the SLS.

2. The system of claim 1 which further includes a signal transmitting valve actuator limit switch operatively connected to the SSV and in communication with the SLS; and an alarm that is actuated if the actuator limit switch does not issue a signal after to passage of a predetermined period of time following transmission of a signal by the SLS to the SSV to initiate opening or closing.

3. The system of claim 1 in which the SSV is provided with an electrically-operated fail-safe actuator with a positive spring return.

4. The system of claim 1 in which the variable speed drive controller for the ESP is adapted to send a signal to slow the speed of the ESP prior to the power interruption in step (f).

5. The system of claim 1 in which the flowline piping up to and including the SSV is rated for a maximum operating pressure that corresponds to the maximum wellhead shut-in pressure.

6. The system of claim 1 which includes three pressure transmitting sensors operatively connected to the SLS and the pressure in the flowline is determined by voting the sensor signal values in a two-out-of-three protocol.

7. The system of claim 6, which includes an alarm that is actuated if the values of the pressure sensor signals processed by the SLS vary by more than a predetermined value.

8. The system of claim 1 which includes means for independently transmitting an overriding emergency shutdown signal to the ESP that takes precedence over any active safety test that is in process, whereby the ESP is shutdown in response to the emergency shutdown signal.

9. The system of claim 1 in which the SLS is preprogrammed to issue control signals to the SSV and the variable speed drive controller based on the flowline pressure as transmitted from the pressure sensing transmitters.

10. The system of claim 2 which includes means for actuating the alarm when no change in flowline pressure is transmitted by the plurality of sensors within a predetermined period of time following transmission by the SLS of a signal to the SSV to initiate a closing or opening cycle.

11. A method for the safety and fault testing of a wellhead surface piping flowline carrying gas and/or oil that is pressurized by a downhole electric submersible pump (ESP), the flowline being equipped with a safety shut-off valve (SSV), the method comprising:

a. providing a plurality of electronic pressure transmitting sensors on the surface flowline upstream of the SSV;

b. providing a variable speed controller (VSC) for adjusting the speed of the ESP;

c. providing a programmed safety logic solver (SLS) that is in control communication with the SSV and the variable speed controller for the ESP, and that receives and records data transmitted by the plurality of pressure sensors;

d. initiating a safety and fault test from the SLS by transmitting a signal to the SSV to initiate movement to its fully closed position;

e. monitoring the pressure data received from the pressure sensors;

f. transmitting a signal from the SLS to the VSC to reduce the speed of the ESP in response to a predetermined increase of the internal flowline pressure;

g. bringing the SSV to a fully-closed position while continuing the operation of the ESP at a controlled speed that is determined by the SLS to maintain the flowline pressure within a predetermined safe range;

h. transmitting a signal from the SLS to move the SSV to its fully-opened position; and i. transmitting a signal from the SLS to the VSC to increase the speed of the ESP in response to flowline pressure data.

12. The method of claim 11 in which the data from the plurality of pressure sensors is voted by the SLS.

13. The method of claim 11 which includes receiving and recording data on predetermined performance characteristics of one or more of the components selected from the SSV, pressure sensors, ESP and VSC during the safety test, comparing the respective component's performance characteristics with existing standards and providing a display of the comparative data.

14. The method of claim 11 which includes terminating the safety and fault test in response to an emergency signal received by the SLS, and simultaneously transmitting signals to move the SSV to its fully closed position and to shut down the ESP.

15. The method of claim 11 which includes initiating a failed test alarm in the event that the flowline pressure does not increase following the transmission of the SLS signal to close the SSV.

16. The method of claim 11 which includes initiating a failed test alarm if the flowline pressure does not decrease following the transmission of the SLS signal to reduce the speed of the ESP in step (f).

17. The method of claim 11 which includes transmitting a shutdown signal from the SLS to the ESP if no reduction in flowline pressure is detected after transmission of the signal to open the SSV.

18. The method of claim 11 which includes providing the SSV with a signal transmitting valve actuator limit switch that transmits a fully-opened and fully-closed signal to the SLS;

initiating a time clock in the SLS when a signal is transmitted to close and/or open the SSV; and initiating a failed test alarm is no movement is signaled by the limit switch after a predetermined period of time.

19. The method of claim 11 which includes monitoring the variance in pressure data received by the SLS and initiating a fault alarm if the difference in the data from one of the pressure sensors when compared to that of the other two exceeds a predetermined value.

* * * * *